United States Patent [19]

Sellars

[11] Patent Number: 5,063,621

[45] Date of Patent: Nov. 12, 1991

[54] BATH CHAIR

[76] Inventor: Ceola Sellars, 5194 Cresser, Memphis, Tenn. 38116

[21] Appl. No.: 547,053

[22] Filed: Jul. 2, 1990

[51] Int. Cl.[5] ..... A47K 3/02

[52] U.S. Cl. ..... 4/568; 4/579

[58] Field of Search ..... 4/560–566, 4/571, 572, 573, 575, 576, 578, 579, 589, 590, 604, 611, 528–532, 567, 568, 570, 547; 297/27, 28, 38

[56] References Cited

U.S. PATENT DOCUMENTS

| | | | |
|---|---|---|---|
| 2,460,308 | 2/1949 | Pribil | 4/572 |
| 2,582,439 | 1/1952 | Kavanagh | 4/579 X |
| 2,957,184 | 10/1960 | Smith | 4/590 |
| 2,985,889 | 5/1961 | Fain et al. | 4/579 X |
| 3,040,335 | 6/1962 | Gellmann | 4/579 X |
| 3,099,478 | 7/1963 | Pearlstine | 297/28 |
| 3,169,253 | 2/1965 | Segar | 4/611 |
| 3,252,167 | 5/1966 | Eddy | 4/578 |
| 3,280,409 | 10/1966 | Cotner | 4/578 X |
| 3,545,016 | 12/1970 | Schorken | 4/572 X |
| 3,961,380 | 6/1976 | Garr | 4/573 X |
| 4,100,628 | 7/1978 | Franzl | 4/579 |
| 4,150,445 | 4/1979 | Bailey | 4/567 X |
| 4,160,292 | 7/1979 | Kuether et al. | 4/590 X |
| 4,170,045 | 10/1979 | Estes | 4/589 |
| 4,237,561 | 12/1980 | Britton | 4/579 X |
| 4,252,371 | 2/1981 | Lehnen | 297/27 X |
| 4,254,517 | 3/1981 | Herman, Jr. | 4/564 |
| 4,715,650 | 12/1987 | Berman et al. | 297/28 |
| 4,719,653 | 1/1988 | Bishop et al. | 4/572 |
| 4,809,368 | 8/1989 | Johansson | 4/579 X |
| 4,881,281 | 11/1989 | Lavoine et al. | 4/572 |

FOREIGN PATENT DOCUMENTS

| | | | |
|---|---|---|---|
| 8803000 | 5/1988 | PCT Int'l Appl. | 4/572 |

*Primary Examiner*—Henry J. Recla
*Assistant Examiner*—Robert M. Fetsuga
*Attorney, Agent, or Firm*—Walker & McKenzie

[57] ABSTRACT

A bath chair for supporting a bather relative to a supply of water. The bath chair includes a body having a seat portion for supporting the bather's buttocks, and having a back portion for supporting the bather's back. The body preferably has a plurality of apertures through the seat portion for allowing water to pass therethrough and a plurality of apertures through the back portion for allowing water to pass therethrough.

3 Claims, 2 Drawing Sheets

BATH CHAIR

BACKGROUND OF THE INVENTION

1. Field of the Invention

The present invention relates, in general, to a chair particularly suited for the bathing of infirm or otherwise disabled persons.

2. Information Disclosure Statement

The inventor is aware of the following patents which may be relevant to the present invention: Kavanagh, U.S. Pat. No. 2,582,439; Fain et al, U.S. Pat. No. 2,985,889; Eddy, U.S. Pat. No. 3,252,167; Cotner, U.S. Pat. No. 3,280,409; Garr, U.S. Pat. No. 3,961,380; and Herman, U.S. Pat. No. 4,254,517. Kavanagh discloses a pneumatic seat and back rest lounging device to comfortably support the back and head of a bather. Fain et al discloses a bathing recliner which will comfortably support a bather in a reclining position. Eddy discloses a bathtub safety seat having brackets which are permanently secured to the walls of a bathtub by waterproof cement, and having a bench-type seat that is pivotally attached to the brackets. Cotner discloses a lift for a sitz bath that includes a chair and a hydraulic mechanism for moving the chair and occupant into and out of the bathtub. Garr discloses a bathtub appliance having a bladder for being filled with warm water on which a persons can sit or recline, and a flexible cover attached to the bladder forming a heated enclosure for the persons, body with only the persons's head extending out of the enclosure. Herman discloses a bathtub lift assembly including an inflatable cushion positioned on the floor of a bathtub for being inflated with water from the bathtub faucet and for being deflated while a person is sitting thereon to lower the person to the floor of the bathtub.

None of the above patents disclose or suggest the present invention. For example, none of the above patents disclose or suggest a bath chair comprising a body including a seat portion for supporting a bather's buttocks, and including a back portion for supporting the bather's back; the body having a plurality of apertures through the seat portion for allowing water to pass therethrough and having a plurality of apertures through the back portion for al owing water to pass therethrough.

SUMMARY OF THE INVENTION

The present invention is directed toward providing a new and unique chair which provides a safe and convenient means for adequately bathing infirm or disabled persons. The chair of the present invention is particularly suited for the bathing of infirm or otherwise disabled persons. The present invention provides a means, by which, a person, in a seated position, may bathe or be bathed in a safe and comfortable manner.

Safe and adequate bathing of infirm and disabled patients in health care facilities, nursing homes and private homes presents a major problem. Patients are often unable to stand for shower bathing or unable to enter and/or exit a bathtub. In such cases, a considerable amount of assistance is required. Such assistance is not always available and often the result is inadequate bathing of some patients and some patients may go unbathed for long periods of time. The importance of patient cleanliness is widely recognized and accepted and strongly indicates a need for a device that allows a patient to bathe or be bathed safely and thoroughly in a seated position with a minimum amount of assistance.

The bath chair of the present invention includes a body having a seat portion for supporting the bather's buttocks, and having a back portion for supporting the bather's back. The body preferably has a plurality of apertures through the seat portion for allowing water to pass therethrough and has a plurality of apertures through the back portion for allowing water to pass therethrough.

DESCRIPTION OF THE PREFERRED EMBODIMENT

Figure 1:
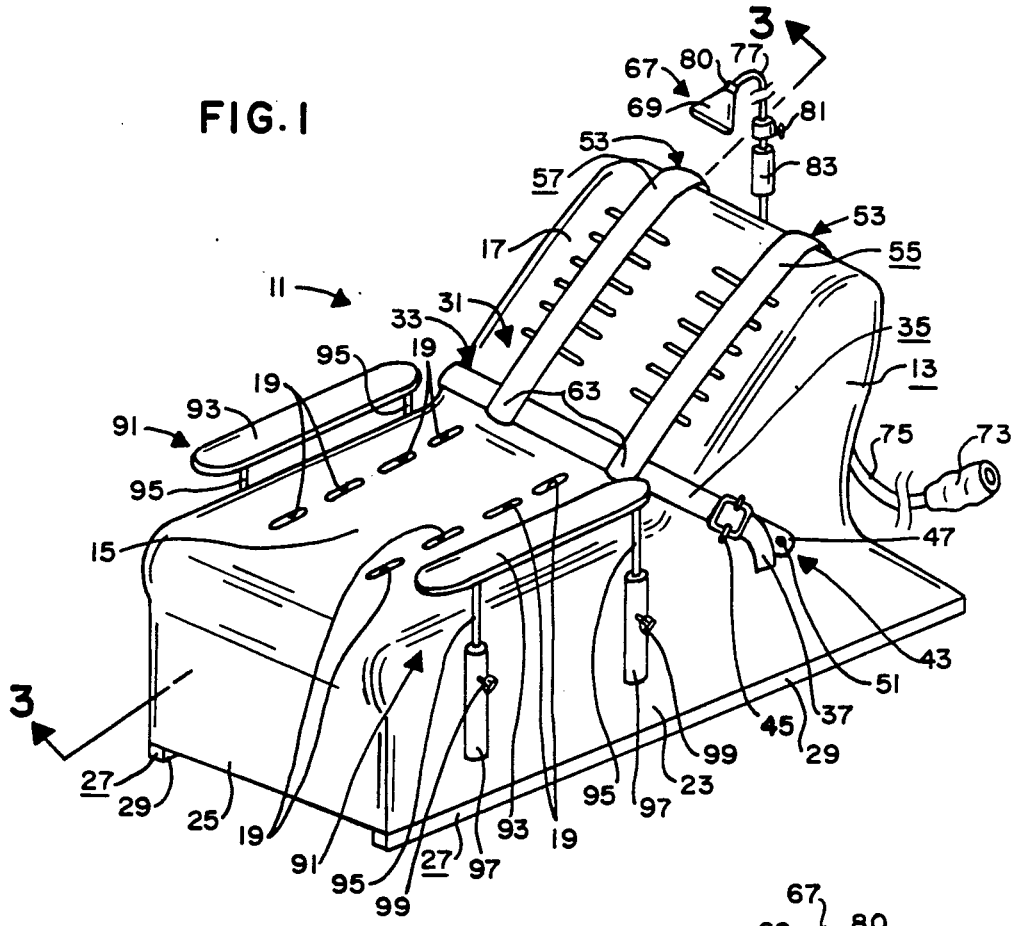
FIG. 1 is a perspective view of the bath chair of the present invention.

The preferred embodiment of the bath chair of the present invention is shown in FIGS. 1-5 and identified by the numeral 11. The bath chair 11 is used to provide support for a bather B relative to a supply of water such as a typical bathtub faucet F. While the preferred embodiment o the present invention is designed to be used with a standard bathtub or the like, its use need not be limited to such locations. Thus, the bath chair 11 may be used in a shower stall or any other location where an adjustable temperature water supply and a water drain are available.

The bath chair 11 includes a chair-like body 13. The body 13 includes a seat portion 15 for supporting the lower body of the bather B (e.g., the bather's buttocks and thighs). The body 13 includes a back portion 17 for supporting the upper body of the bather B (e.g., the bather's back). The body 13 has a series of outlet openings in the seat portion 15 and back portion 17 (e.g., two rows of slit shaped openings) to facilitate water drainage from the chair 11 and to allow waste water to drain from the chair surface into the drain D of the tub T, etc. More specifically, the body 13 has a plurality of apertures 19 through the seat portion 15 for allowing water to drain or pass therethrough, and has a plurality of apertures 21 through the back portion 17 for allowing water to drain or pass therethrough. The apertures 19 may extend lengthwise of the seat portion 15 in two spaced apart rows as clearly shown in FIG. 1 to prevent water from "puddling" beneath the bather's buttocks and thighs as will now be apparent to those skilled in the art. The apertures 21 may extend crosswise of the back portion 17 in two spaced apart rows as clearly shown in FIG. 1 to prevent water from "puddling" beneath the bather's back as will now be apparent to those skilled in the art.

Figure 2:
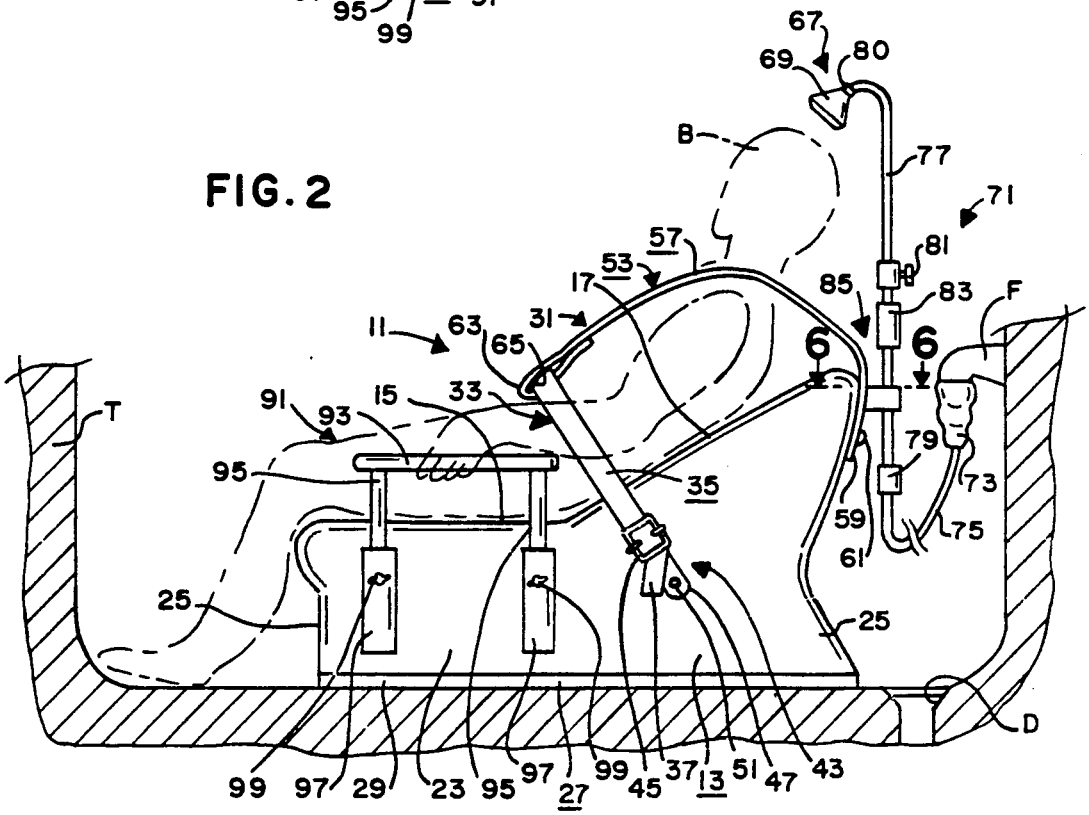
FIG. 2 is a side elevational view of the bath chair of the present invention shown positioned within a cross-sectioned bathtub and with a bather supported thereon.
Figure 3:
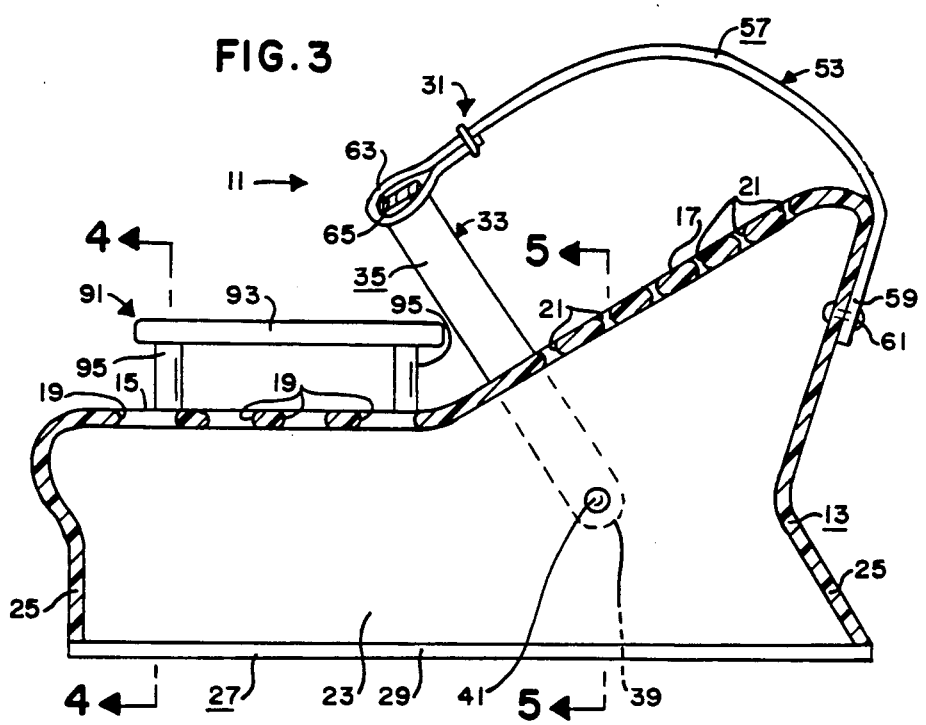
FIG. 3 is a sectional view substantially as taken on line 3—3 of FIG. 1.
Figure 4:
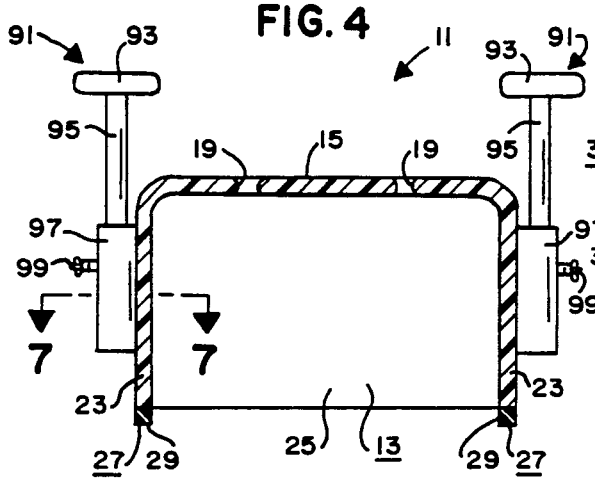
FIG. 4 is a sectional view substantially as taken on line 4—4 of FIG. 3.
Figure 5:
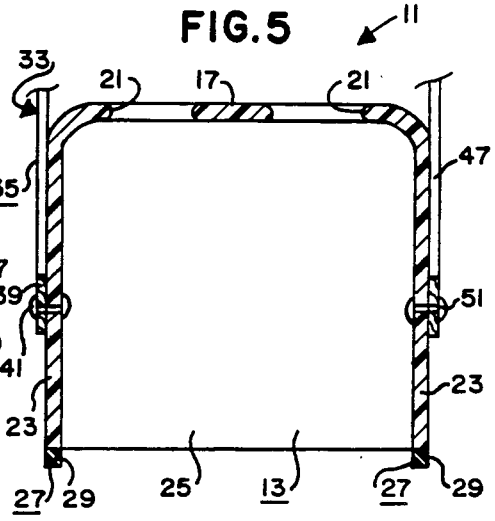
FIG. 5 is a sectional view substantially as taken on line 5—5 of FIG. 3.

The specific shape and size of the body 13 may vary to provide the bather B proper comfort and security. Preferably, the body 13 is shaped and sized so as to fit within a tub T such as a typical bathtub or the like as clearly shown in FIG. 2. The plane of the back portion 17 of the body 13 of the bath chair 11 is preferably tilted 30 degrees upward from the plane of the seat portion 15 of the body 13 of the bath chair 11 as clearly shown in FIGS. 2 and 3 to provide comfort for the bather B, etc. The body 13 of the bath chair 11 is preferably molded or otherwise constructed out of a sturdy, durable material such as high-impact plastic, or a glass fiber product such as Fiberglas, etc., as an integral, one-piece unit with a body-contoured seat and back, and with a mildly grained surface to prevent slippage in any specific manner as will now be apparent to those skilled in the art. For ease of construction and operation, the body 13 is preferably substantially hollow as indicated in FIGS. 3, 4 and 5. Thus, the seat portion 15 and back portion 17 preferably consist of a plate-like construction supported by plate-like sidewalls 23 and end walls 25 as will now be apparent to those skilled in the art.

The bath chair 11 preferably includes grip means 27 for being positioned on the bottom of the body 13 of the bath chair 11 and for preventing the bath chair 11 from sliding. The grip means 27 preferably includes a strip 29 of non-skid rubber or the like attached to the bottom edge of each sidewall 23. Each strip 29 of non-skid rubber or the like preferably extends the full length of the bottom of each sidewall 23 to prevent the body 13 of the chair 11 from slipping on the bottom of the tub T or other surface as will now be apparent to those skilled in the art.

The bath chair 11 preferably includes a stabilizer harness or belt means 31 for securing the bather B to the body 13 of the bath chair 11. The belt means 31 preferably includes waist belt means 33 for securing the bather's waist to the body 13 of the bath chair 11. The waist belt means 33 preferably includes a waist belt 35 having a first end 37 for being attached to the body 13 of the bath chair 11 and having a second end 39 for being attached to the body 13 of the bath chair 11. The second end 39 of the waist belt 35 is preferably fixedly attached to the body 13 of the bath chair 11 by way of a rivet 41 or the like (see FIGS. 3 and 5) as will now be apparent to those skilled in the art.

The belt means 31 preferably includes adjustment means 43 for adjustably attaching the first end 37 of the waist belt 35 to the body 13 of the bath chair 11 and for allowing the effective length of the waist belt 35 to be varied, depending on the size of the bather B, etc., as will now be apparent to those skilled in the art. The adjustment means 43 preferably includes a buckle means 45 for receiving the first end 37 of the waist belt 35, and means for attaching the buckle means 45 to the body 13 of the bath chair 11. More specifically, the adjustment means 43 preferably includes a strap 47 having a first end fixedly attached to the buckle means 45 by stitching or the like, and having a second end fixedly attached to the body 13 of the bath chair 11 by a rivet 51 or the like (see, in general, FIG. 5).

The belt means 31 preferably includes shoulder belt means 53 for securing the bather's shoulders and upper torso to the body 13 of the bath chair 11. The shoulder belt means 53 preferably includes a first shoulder belt 55 for extending over one of the bather's shoulders and preferably includes a second shoulder belt 57 for extending over the other of the bather's shoulders. Each shoulder belt 55, 57 preferably has a first end 59 fixedly attached to the back portion of the body 13 of the bath chair 11 (i.e., to the back end wall 25) by way of a rivet 61 or the like (see FIGS. 2 and 3) as will now be apparent to those skilled in the art. Each shoulder belt 55, 57 preferably has a second end 63 attached to the waist belt 35. More specifically, the second end 63 of each shoulder belt 55, 57 preferably has a loop portion 65 for adjustably attaching the second end 63 of each shoulder belt 55, 57 to the waist belt 35 as will now be apparent to those skilled in the art.

The waist belt 35 and shoulder belts 55, 57 may consist of elongated lengths of standard synthetic fiber webbing or the like as will now be apparent to those skilled in the art.

The bath chair 11 preferably includes spray means 67 for allowing temperature controlled water to be sprayed onto the bather B. The spray means 67 preferably includes a shower head 69 and coupling means 71 for coupling the shower head 69 to a source of pressurized temperature controlled water such as a standard mixing valve or faucet F. The shower head 69 preferably consist of an off-the-shelf shower head well known to those skilled in the art. The shower head 69 is preferably an adjustable flow type with a delivery range from a fine spray to a solid stream and is adjustable by way of a lever or the like (not shown) as will now be apparent to those skilled in the art. The coupling means 71 preferably includes a soft rubber adapter 73 for slipping over the distal end of the faucet F, a flexible hose 75 (rubber or plastic, etc.) extending from the adapter 73, and a rigid pipe 77 extending from the flexible hose 75 to the shower head 69. A connector 79 is preferably provided for making a fluid-tight connection between the flexible hose 75 and the rigid pipe 77. The shower head 69 preferably includes a typical ball-and-socket fluid-tight connector 80 for connection to the end of the rigid pipe 77 opposite the flexible hose 75 to allow for full circle adjustment of the shower head 69 as will now be apparent to those skilled in the art. The end of the rigid pipe 77 is preferably threaded to accept the standard connector 80. The spray means 67 preferably includes valve means 81 for allowing the flow of water from the shower head 69 to be controlled. The valve means 81 preferably consists of any type manual on-off valve connected to the rigid pipe 77 of the coupling means 71 as shown in FIGS. 1 and 2, etc., as will now be apparent to those skilled in the art. The spray means 67 preferably includes hand grip means 83 for allowing the shower head 69 to be manually held and manipulated, etc., as will now be apparent to those skilled in the art. The hand grip means 83 may consist of a rubber tube-like grip positioned on the rigid pipe 77 of the coupling means 71 as will now be apparent to those skilled in the art. The rigid pipe 77 preferably has a 45 degree bend substantially adjacent the shower head 69.

Figure 6:
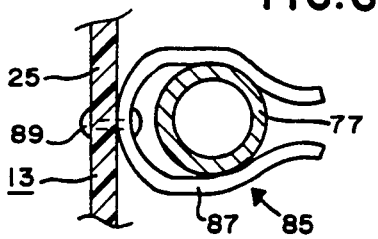
FIG. 6 is an enlarged sectional view substantially as taken on line 6—6 of FIG. 2 with portions thereof omitted for clarity.
Figure 7:
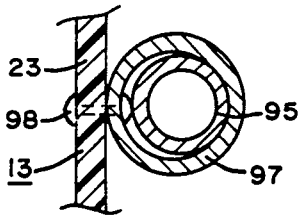
FIG. 7 is an enlarged sectional view substantially as taken on line 7—7 of FIG. 4 with portions thereof omitted for clarity.

The bath chair 11 preferably includes attachment means 85 for removably attaching the spray means 67 to the body 13 of the bath chair 11 in a position for spraying water onto the bather B. The attachment means 85 preferably consists of a typical spring clip 87 for being fixedly attached to the back portion of the body 13 of the bath chair 11 (i.e., to the back end wall 25) by way of a rivet 89 or the like (see FIG. 6) as will now be apparent to those skilled in the art. The spring clip 87 allows the shower head 69 to be attached to the body 13 of the bath chair 11 in a position to deliver water to the head and shoulders of the bather B seated on the body 13 of the bath chair 11 and further allows the shower head 69 to be removed from the body 13 of the bath chair 11 and hand held for directing water to other parts of the bather's body, etc.

The bath chair 11 preferably includes arm rest means 91 attached to body 13 of the bath chair 11 on either side of the seat portion 15 for supporting the bather's arms, etc. The arm rest means 91 are preferably adjustable in height and are preferably completely removable from the body 13 of the bath chair 11. More specifically, each arm rest means 91 preferably includes an arm rest portion 93, a pair of spaced post members 95 fixedly attached to and depending from each arm rest portion 93, and a pair of spaced pipe-like retainers 97 fixedly attached to each sidewall 23 of the body 13 of the bath chair 11 by way of rivets 98 or the like for slidably receiving the post members 95 to couple the arm rest portions 93 to the body 13 of the bath chair 11 as will now be apparent to those skilled in the art. Each retainer 97 is preferably equipped with a thumb screw 99 for securing the post members 95 thereto as will now be apparent to those skilled in the art. Thus, the height of the arm rest portions 93 can be varied by merely loosening the thumb screws 99, manually raising or lowering the arm rest portions 93, and then retightening the thumb screws 99. Further, either arm rest portion 93 (and the associated post members 95) can be completely removed from the body 13 of the bath seat 11 by merely loosening the thumb screws 99 and manually lifting the arm rest portion 93 completely off the body 13 of the bath chair 11 to allow easy ingress and egress by the bather B to the body 13 of the bath chair 11 as will now be apparent to those skilled in the art. The arm rest portions 93 are preferably constructed out of the same material as the body 13 of the bath chair 11 and the post members 95 and retainers 97 are preferably constructed out of a durable, non-tarnishing metal as will now be apparent to those skilled in the art In ordinary practice, the bath chair 11 is placed inside a standard tub T with the back of the chair 11 toward the faucet F. The bather B is seated in the chair 11 with or without assistance. The stabilizing harness or belt means 31 is put in place and properly adjusted and secured. The arm rest means 91 are put in place and properly adjusted. The water delivery system (i.e., the spray means 67) is connected to the water mixing faucet F and with the valve means 81 open, the faucet F is turned on and adjusted to the proper flow and temperature by testing at the shower head 69. The valve means 81 is then closed and the shower head 69 positioned above the head of the bather B by securing the rigid pipe 77 into the spring clip 87. As bathing proceeds, the shower head 69 may be re-positioned or hand held with the waste water being carried away through the apertures 19, 21 to the drain D in the tub T.

As thus constructed, the present invention provides a bath chair that is equipped with a stabilizing safety belt and shoulder straps, that allows temperature controlled water supplied from an adjustable flow shower head to be directed to any part of a bather's body, that allows waste water to be drained from the chair by way of a series of outlet openings in the seat and back of the chair, and provides adjustable, removable arm rests for comfort and convenience.

Although the present invention has been described an illustrated with respect to a preferred embodiment and a preferred use therefor, it is not to be so limited since modifications and changes can be made therein which are within the full intended scope of the invention.

I claim:

1. A bath chair for being positioned within a standard bathtub and for supporting a bather in a seated position in said standard bathtub, said bath chair comprising:

a. a body including:

i. a seat portion for supporting said bather's buttocks; and, ii. a back portion for supporting said bather's back; said body having a plurality of apertures through said seat portion for allowing water to pass therethrough; said body having a plurality of apertures through said back portion for allowing water to pass therethrough; said seat portion being fixed relative to said back portion; the plane of said back portion of said body of said bath chair being tilted at least 30 degrees upward from the plane of said seat portion of said body of said bath chair for supporting said bather in a seated position; and, b. arm rest means attached to said body of said bath chair for supporting said bather's arms, said arm rest means being adjustable in height.

2. A bath chair for supporting a bather relative to a supply of water, said bath chair comprising:

a) a body including a seat portion for supporting said bather's buttocks, and including a back portion for supporting said bather's back; said body having a plurality of apertures through said seat portion for allowing water to pass therethrough; said body having a plurality of apertures through said back portion for allowing water to pass therethrough; and b) arm rest means attached to said body of said bath chair for supporting said bather's arms; said arm rest means being adjustable in height; said arm rest means being completely removable from said body of said bath chair for allowing easy ingress and egress of the bather into and from said body of said bath chair.

3. A bath chair for being positioned within a standard bathtub and for supporting a bather in a seated position in said standard bathtub, said bath chair comprising:

a) a body including a seat portion for supporting said bather's buttocks, and including a back portion for supporting said bather's back; the plane of said back portion being tilted at least 30 degrees upward from the plane of said seat portion for supporting said bather in a sitting position; said body having a plurality of slit shaped openings through said seat portion for allowing water to pass therethrough and having a plurality of slit shaped openings through said back portion for allowing water to pass therethrough; said plurality of slit shaped openings through said seat portion extending lengthwise of said seat portion and being arranged in two spaced apart rows; said plurality of slit shaped openings through said back portion extending crosswise of said back portion and being arranged in two spaced apart rows;

b) belt means for securing said bather to said body of said bath chair;

c) spray means for allowing water to be sprayed onto said bather; said spray means including a shower head, including coupling means for coupling said shower head to a source of pressurized water, including valve means for allowing the flow of water from said shower head to be controlled and including hand grip means for allowing said shower head to be manually held;

d) attachment means for removably attaching said spray means to said body of said bath chair in a position for spraying water onto said bather;

e) grip means for being positioned on the bottom of said body of said bath chair and for preventing said bath chair from sliding; said grip means including strips of non-skid rubber attached to the bottom of said body of said bath chair to prevent said body of said bath chair from slipping on the bottom of said bathtub; and f) arm rest means attached to said body of said bath chair for supporting said bather's arms; said arm rest means being adjustable in height and being completely removable from said body of said bath chair for allowing easy ingress and egress of the bather into and from said body of said bath chair.

* * * * *